US007303191B2

(12) United States Patent
Takagi et al.

(10) Patent No.: US 7,303,191 B2
(45) Date of Patent: Dec. 4, 2007

(54) SHEET CONVEYING APPARATUS AND IMAGE FORMING APPARATUS

(75) Inventors: Masafumi Takagi, Ibaraki (JP); Takeshi Suga, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 547 days.

(21) Appl. No.: 10/899,077

(22) Filed: Jul. 27, 2004

(65) Prior Publication Data

US 2005/0030600 A1 Feb. 10, 2005

(30) Foreign Application Priority Data

Aug. 4, 2003 (JP) ..... 2003-286281

(51) Int. Cl.
*B65H 7/02* (2006.01)

(52) U.S. Cl. ..... 271/227; 271/228

(58) Field of Classification Search ..... 271/227, 271/228; 399/372, 395

See application file for complete search history.

(56) References Cited

U.S. PATENT DOCUMENTS

| | | | | |
|---|---|---|---|---|
| 5,678,127 | A | 10/1997 | Suga | 399/45 |
| 6,059,285 | A | 5/2000 | Suga et al. | 271/228 |
| 6,260,840 | B1 | 7/2001 | Suga et al. | 271/10.12 |
| 6,581,929 | B2 * | 6/2003 | Hiramitsu | 271/228 |
| 6,739,590 | B2 * | 5/2004 | Otsuka | 271/227 |
| 6,779,791 | B2 * | 8/2004 | Kawamura et al. | 271/228 |
| 6,811,152 | B2 * | 11/2004 | Delfosse et al. | 271/225 |
| 7,195,238 | B2 * | 3/2007 | Suga et al. | 271/228 |
| 2002/0060417 | A1 * | 5/2002 | Hiramitsu | 271/227 |
| 2003/0057637 | A1 * | 3/2003 | Kawamura et al. | 271/227 |
| 2004/0081496 | A1 | 4/2004 | Endo et al. | 399/390 |
| 2005/0012263 | A1 * | 1/2005 | Koyanagi et al. | 271/227 |
| 2005/0035528 | A1 * | 2/2005 | Suga et al. | 271/10.12 |

FOREIGN PATENT DOCUMENTS

| | | |
|---|---|---|
| JP | 10-67448 | 3/1998 |

* cited by examiner

*Primary Examiner*—David H Bollinger
(74) *Attorney, Agent, or Firm*—Fitzpatrick, Cella, Harper & Scinto

(57) ABSTRACT

The present provides a sheet conveying apparatus for conveying a sheet by sheet conveying device, including detection device which detects a skew of a conveyed sheet with respect to a sheet conveying direction, skew correcting device which pivots, in a state nipping the sheet in a skewed state, in a direction for correcting the skew of the sheet, based on a detection signal from the detection device, and control device provided with calculation device which calculates a front end position of the sheet of which skew is corrected by the pivotal movement of the skew correcting device, based on a detection signal from the detection device.

3 Claims, 12 Drawing Sheets

SKEW CONVEYING CORRECTION

SHEET CONVEYING APPARATUS AND IMAGE FORMING APPARATUS

This application claims priority from Japanese Patent Application No. 2003-286281 filed on Aug. 4, 2003, which is hereby incorporated by reference herein.

BACKGROUND OF THE INVENTION

1. Field of the Invention

The present invention relates to a sheet conveying apparatus for supplying an image forming apparatus with a sheet, and also to a skew correction of a conveyed sheet and a sheet alignment in an image forming portion of an image reading portion.

2. Related Background Art

In an image forming apparatus such as a copying apparatus, a printer or a facsimile apparatus, a sheet conveying apparatus is provided for conveying a sheet such as a recording sheet or an original to an image forming portion or an image reading portion. Some of such sheet conveying apparatus is known to have correction means for correcting a skewed conveying of the sheet in order to rectify a posture and a position of the sheet until it is conveyed to an image forming portion or an image reading portion.

As correcting method for such correcting means, there is known so-called loop registration method utilizing a pair of registration rollers, in which, for example in an image forming apparatus, a front end (leading edge) of a sheet is made to impinge on a nip of stopped registration rollers to form a loop in the sheet, whereby the front end of the sheet is made to be aligned along the nip of the rollers by the elasticity of the roller to correct the skewed conveying, and the registration rollers are thereafter rotated at a predetermined timing to match the front end of the sheet with a front end of an image.

In such loop registration method, however, there is necessitated a loop space for forming a loop, thereby making the apparatus inevitably bulky. Also in case a sufficient loop space cannot be secured, there may result difficulties of generating a jamming (sheet clogging) by a sheet buckling particularly in a sheet of low rigidity such as a thin paper, and generating a noise (so-called loop noise) when the sheet impinges on the registration rollers.

There is also a difficulty that the skew correcting ability varies depending on the rigidity of the sheet. More specifically, in a thin paper with a low rigidity, a contact pressure when the front end of the sheet abuts against the nip of the registration rollers becomes deficient and the front end of the sheet may be unable to sufficiently abut against the paired registration rollers, whereby a complete skew correction is impossible to achieve.

Also in a thick paper of a high rigidity, there may result a difficulty that the sheet penetrates through the nip of the paired registration rollers by an impact at the abutting against the registration rollers, and a measure for example of applying a load or the like to the paired registration rollers for example by a braking member leads to an increase in the cost of the product.

Furthermore, in case of a curling or a dog-ear at the front end of the sheet, the front end of the sheet cannot be exactly aligned along the nip of the paired registration rollers, whereby the skew correction cannot be executed precisely thus deteriorating the precision of printing.

On the other hand, the image forming apparatus and the image reading apparatus have recently become capable, by a digital system, after reading an original, of storing image information thereof as electrical codes in a memory portion. Also at the image formation, the information in the memory portion is read and used for forming an image corresponding to the image information of the original on a photosensitive member by an exposure apparatus such as a laser or an LED array, so that a mechanical movement of an optical apparatus or the like can be dispensed with even in a copying operation of plural sheets.

It is thus rendered possible to shorten a gap between sheets, or a sheet interval, and to process many sheets within a short period. As a result, it is becoming possible, for example at the image formation in an image forming apparatus, to increase the practical image forming speed without increasing the process speed.

However, in case of employing a sheet conveying apparatus of the aforementioned loop registration method, the sheet interval is inevitably determined as the sheet is stopped once for forming a loop, thereby seriously affecting the improvement of the image forming speed (productivity).

In order to avoid such difficulty, Japanese Patent Application Laid-open No. H10-067448 proposes a sheet conveying apparatus employing a registration method capable of automatically correcting a skewed sheet conveying.

This sheet conveying apparatus is provided with a pair of conveying rollers (registration rollers) for nipping and conveying a sheet, a sensor for detecting a skew amount of the sheet provided at a downstream side of the conveying rollers in a conveying direction thereof, and skew correcting means for conveying rollers, which inclines the conveying rollers in a direction perpendicular to the sheet conveying direction, and corrects a skewed conveying of the sheet by displacing the conveying roller according to the skew of the sheet, based on information from the skew detecting sensor.

In a prior image forming apparatus, when a toner image formed in an image forming portion (photosensitive drum) is transferred onto a sheet, the sheet is advanced to a transfer portion at a predetermined timing in order to align the front end of the image in the transfer portion with the front end of the sheet, namely in order to synchronize the front end of the sheet with the toner image. Also in a prior image reading apparatus, the sheet alignment in an image reading portion is achieved by advancing an original to the image reading portion at a predetermined timing.

For advancing a sheet at a predetermined timing, there may be employed a method of employing the aforementioned registration rollers or a method of detecting a front end of the sheet by a sensor provided in a sheet conveying path and advancing the sheet based on a signal of such sensor. However, as explained before, the method employing the registration rollers cannot attain a sufficient precision because it is affected by the rigidity of the sheet.

On the other hand, the method of advancing the sheet based on the signal from the sensor has a high precision, but, in the aforementioned method of correcting the skewed conveying of the sheet by displacing the conveying roller, since the front end position of the sheet is changed by the skew correction, it is necessary to detect the front end of the sheet after the correction for achieving an exact detection of the front end position of the sheet.

For this reason, the position of the sensor is restricted to a position capable of detecting the front end of the sheet after correction of skew. However such restricted position of the sensor not only complicates the sheet conveying apparatus but also increases the distance from the sheet conveying apparatus to the image forming portion or the image reading portion, so that the image forming apparatus or the image reading apparatus provided with the sheet conveying apparatus is difficult to realize in a compact configuration and becomes costly.

SUMMARY OF THE INVENTION

The present invention has been made in consideration of the foregoing and is to provide a sheet conveying apparatus, an image forming apparatus and an image reading apparatus, capable of improving precision of sheet alignment even in case of correction of skewed conveying.

The present invention provides a sheet conveying apparatus for conveying a sheet by sheet conveying means, of a configuration including:

detection means which detects a skew of a conveyed sheet with respect to a sheet conveying direction;

skew correcting means which pivots, in a state nipping the sheet in a skewed state, in a direction for correcting the skew of the sheet, based on a detection signal from the detection means; and control means provided with calculation means which calculates a front end position of the sheet of which skew is corrected by the pivotal movement of the skew correcting means, based on a detection signal from the detection means.

The present invention also provides an image forming apparatus provided with an image forming portion including an image bearing member on which an image is formed, and a transfer portion for transferring the image formed on the image bearing member onto a sheet, having a configuration including:

detection means which detects a skew of a conveyed sheet with respect to a sheet conveying direction;

registration means which rotates, in a state nipping the sheet in a skewed state, in a direction for correcting the skew of the sheet, based on a detection signal from the detection means; and control means provided with calculation means which calculates a front end position of the sheet of which skew is corrected by the pivotal movement of the skew correcting means, based on a detection signal from the detection means;

wherein the control means controls the sheet conveying speed of the registration means according to the calculated front end position of the sheet, thereby aligning the sheet conveyed by the registration means with an image in the transfer portion.

The present invention also provides an image forming apparatus provided with an image forming portion including an image bearing member on which an image is formed, and a transfer portion for transferring the image formed on the image bearing member onto a sheet, having a configuration including:

detection means which detects a skew of a conveyed sheet with respect to a sheet conveying direction;

registration means which rotates, in a state nipping the sheet in a skewed state, in a direction for correcting the skew of the sheet, based on a detection signal from the detection means; and control means provided with calculation means which calculates a front end position of the sheet of which skew is corrected by the pivotal movement of the skew correcting means, based on a detection signal from the detection means;

wherein the control means controls a timing of an image formation on the image bearing member according to the front end position of the sheet, corrected by the registration means, of which the skew is calculated by the calculation means, thereby aligning the sheet conveyed by the registration means with an image in the transfer portion.

DESCRIPTION OF THE PREFERRED EMBODIMENTS

In the following, the present invention will be explained in detail with reference to accompanying drawings.

Figure 1:
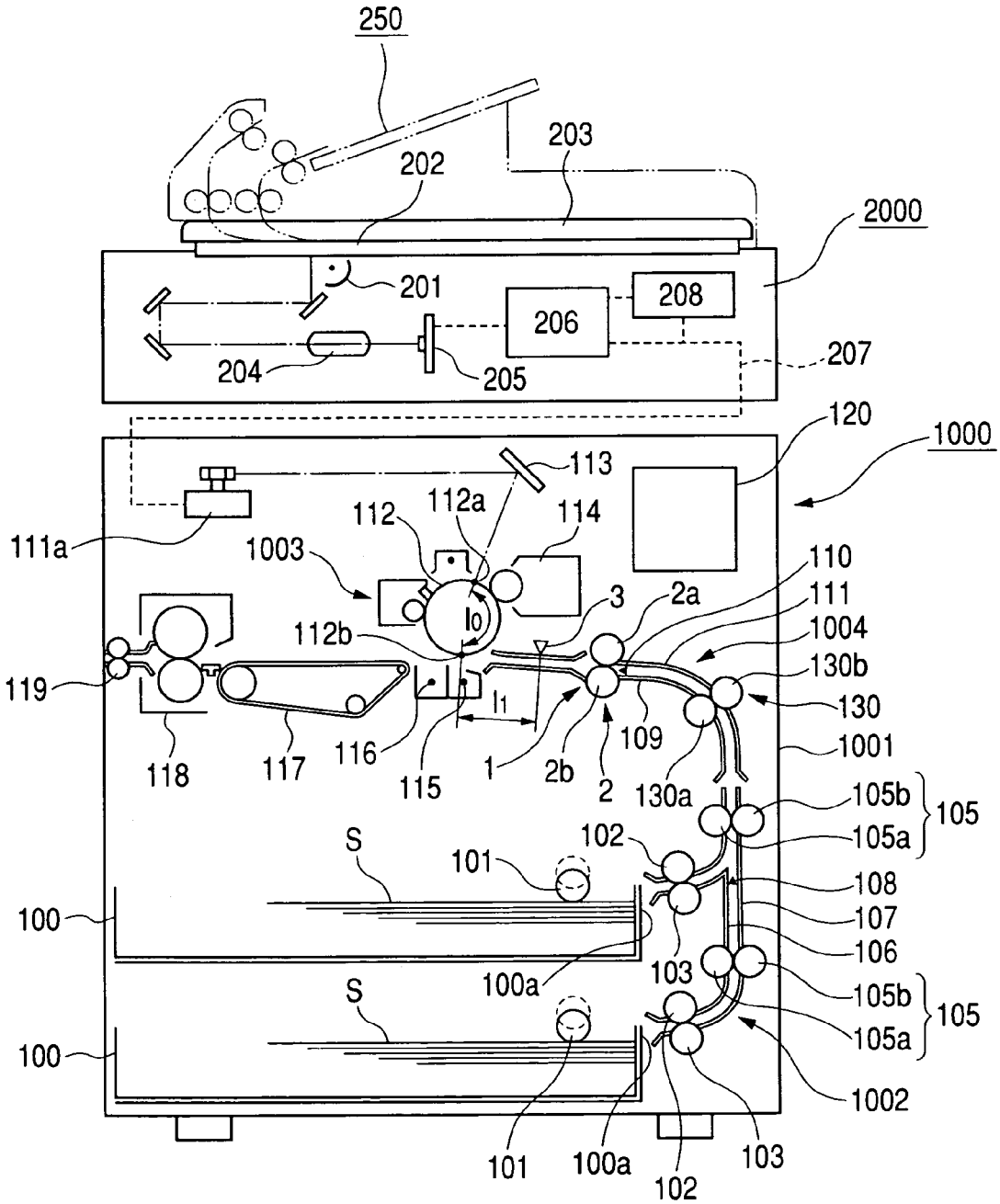
FIG. 1 is a cross-sectional view showing a printer as an example of an image forming apparatus provided with a sheet conveying apparatus in a first embodiment of the present invention.

FIG. 1 is a cross-sectional view showing a printer as an example of an image forming apparatus provided with a sheet conveying apparatus in a first embodiment of the present invention.

Referring to FIG. 1, a printer 1000 is provided with a main body 1001 and a scanner 2000 provided on the printer main body 1001.

The scanner 2000 for reading an original is provided with a light source 201 for a scanning optical system, a platen glass 202, an original pressure plate 203 that can be opened or closed, a lens 204, a light receiving (photoelectric converting) element 205, an image processing portion 206, and a memory portion 208 for storing an image signal processed in the image processing portion 206.

An original reading is executed by irradiating an unillustrated original, placed on the platen glass 202, with a light from the scanning optical system light source 201. A read original image is processed by the image processing portion 206, then converted into an electrically encoded signal 207 and transmitted to a laser scanner 111*a* constituting image forming means. It is also possible to store the encoded image information in the memory portion 208 and to transmit such information to the laser scanner 111*a* in response to a signal from a controller 120 when required.

The printer main body 1001 is provided with a sheet feeding apparatus 1002 for feeding a sheet S, a sheet conveying apparatus 1004 for conveying the sheet S, fed by the sheet feeding apparatus 1002, to an image forming portion 1003, and a controller 120 serving as control means for controlling the printer 1000.

The sheet feeding apparatus 1002 is provided with a cassette 100, a pickup roller 101, and a separating portion constituted of a feeding roller 102 and a retarding roller 103, and the sheets S in the cassette 100 are separated and fed one by one by the function of the pickup roller 101 that is vertically moved/rotated at a predetermined timing.

The sheet conveying apparatus 1004 is provided with paired conveying rollers 105, and a skew correction roller portion 1 having paired rollers 130 before skew correction and paired skew correction rollers 2, and the sheet S fed from the sheet feeding apparatus 1002 passes by the paired conveying rollers 105 through a sheet conveying path 108 constituted of guide plates 106 and 107, then transferred to a sheet conveying path 110 constituted of guide plates 109 and 111, and is then guided to the skew correction roller portion 1. Then it is subjected in the skew correction roller portion 1 to a correction of skew conveying as will be explained later, and is then conveyed to the image forming portion 1003.

The image forming portion 1003, utilizing an electrophotographic process, is provided with a photosensitive drum 112 serving as an image bearing member, a laser scanner 111*a* constituting image writing means, a developing device 114, a transfer charger 115, and a separating charger 116. At the image formation, a laser beam from the laser scanner 111*a* is reflected by a mirror 113 and irradiates an exposure position 112*a* on the photosensitive drum rotating clockwise, thereby forming a latent image on the photosensitive drum, and such latent image on the photosensitive drum is thereafter rendered visible as a toner image by the developing device 114.

The toner image on the photosensitive drum is transferred, in the transfer portion 112*b*, by the transfer charger 115 onto the sheet S. The laser beam irradiating position 112*a* on the photosensitive drum 112 and the transfer portion 112*b* are separated by a distance $I_O$.

The sheet S, bearing thus transferred toner image, is electrostatically separated from the photosensitive drum 112 by the separating charger 116, then conveyed by a conveying belt 117 to a fixing apparatus 118 for fixation of the toner image, and is discharged by discharge rollers 119.

In the drawing, when a skew conveying sensor 3 detects the sheet S which has passed the paired skew correction rollers 2, in response to a detection signal thereof, the controller 120 sends a sheet front end signal (image top signal), for example after T seconds as will be explained later, to the laser scanner 111*a*, which thereby initiates irradiation of the laser beam.

In the present embodiment, the printer main body 1001 and the scanner 2000 are formed as separate units, but they may also be constructed integrally. The printer main body 1001, whether it is separate from or integral with the scanner 2000, functions as a copying apparatus when a process signal of the scanner 2000 is inputted into the laser scanner 111*a* and functions as a facsimile when a facsimile transmission signal is inputted. It also functions as a printer when an output signal of a personal computer is inputted.

On the other hand, the scanner 2000 functions as a facsimile by transmitting a process signal of the image processing portion 206 to another facsimile. Also in the scanner 2000, it is possible to automatically read originals by mounting an auto original feeder 250, represented by chain lines, instead of the pressure plate 203.

Figure 2:
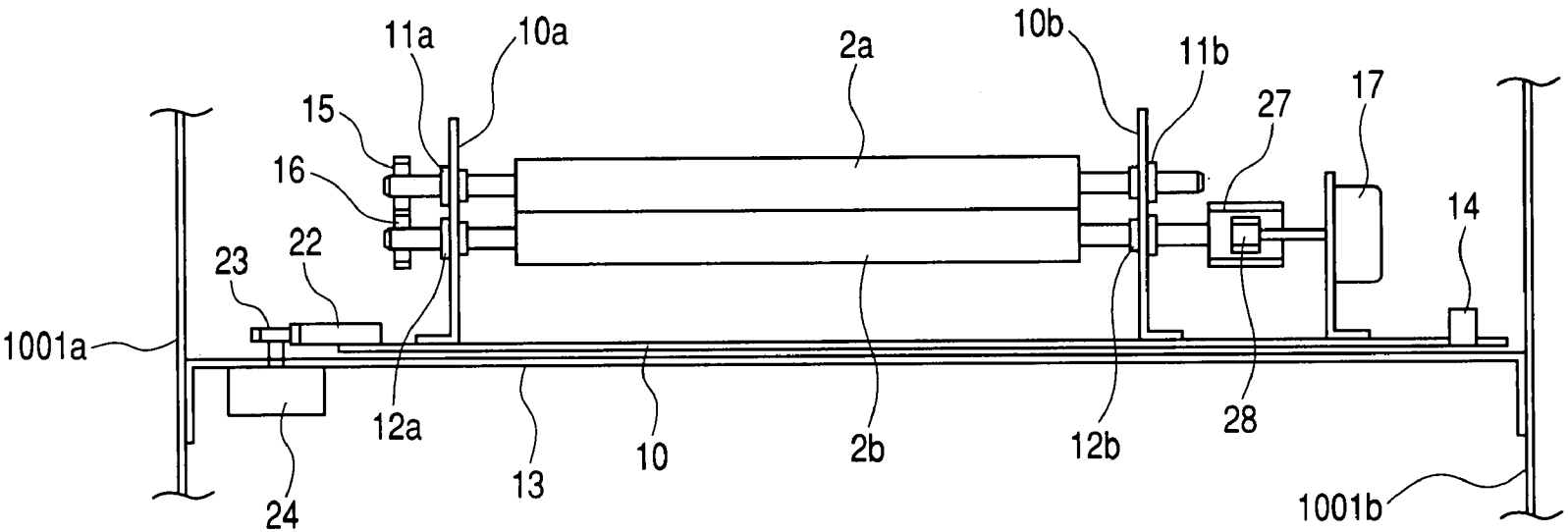
FIG. 2 is a lateral view of skew correction rollers of the sheet conveying apparatus.
Figure 3:
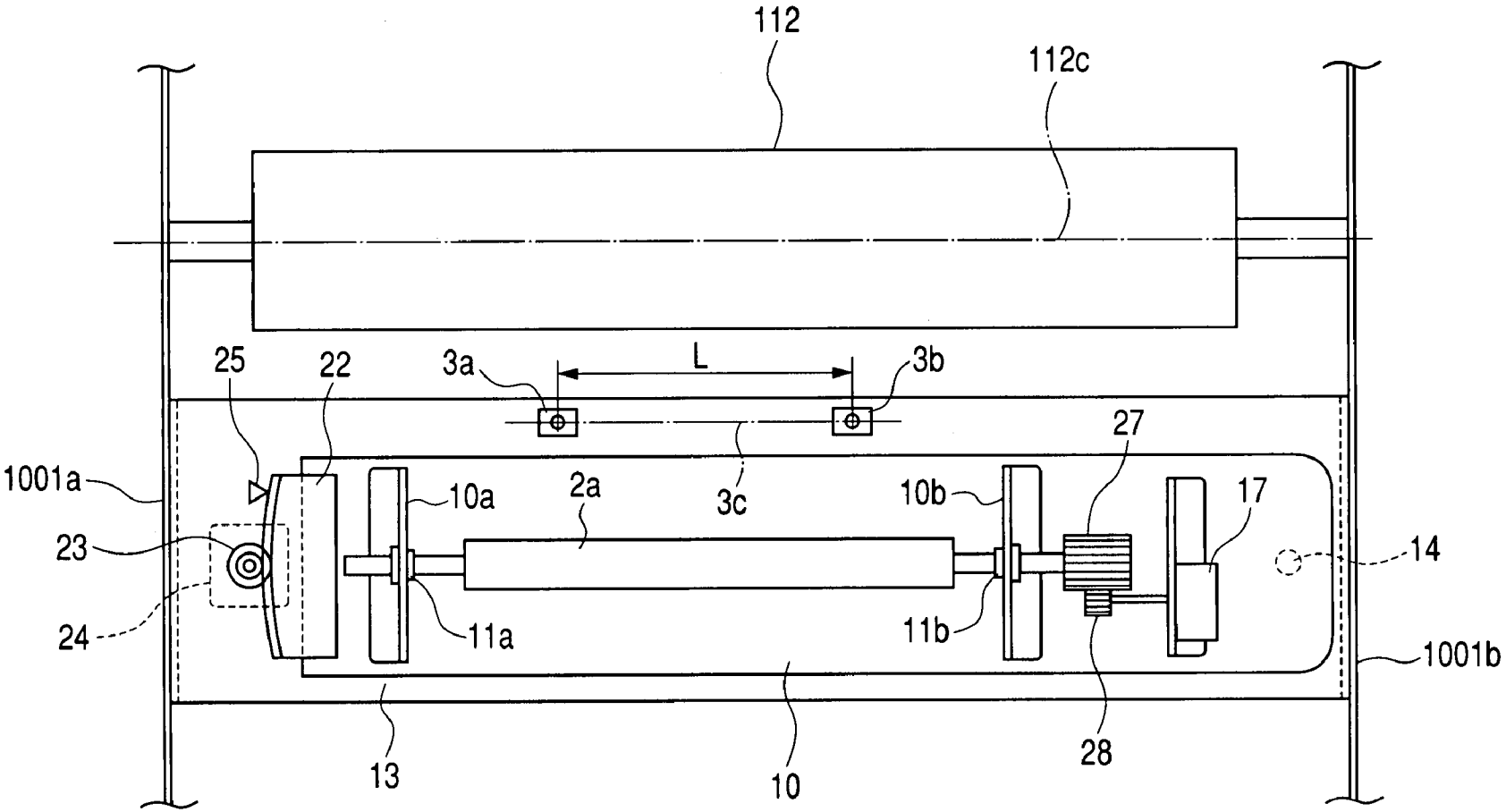
FIG. 3 is a plan view of skew correction rollers of the sheet conveying apparatus.

FIGS. 2 and 3 are respectively a lateral view and a plan view of the skew correction roller portion 1.

As shown in FIGS. 2 and 3, the skew correction roller pair 2 constituting skew correction means is constituted of two (plural) skew correction rollers 2*a*, 2*b*, which are rotatably supported by bearings 11*a*, 11*b*, 12*a* and 12*b* fixed on side plates 10*a* and 10*b* provided perpendicularly on a frame 10.

The upper skew correction roller 2*a* is pressurized, by an unillustrated pressurizing spring, toward the lower skew correction roller 2*b*. Also the skew correction rollers 2*a* and 2*b* are respectively equipped, on a side thereof, with gears 15 and 16 by means of which the skew correction rollers 2*a* and 2*b* are rotated in mutual synchronization.

At an end of a shaft of the lower skew correction roller 2*b*, there is fixed a drive input gear 27, which meshes with a gear 28 fixed on an output shaft of a drive motor 17, whereby the paired skew correction rollers 2 are rotated by the drive of the drive motor 17.

On the other hand, the frame 10 is mounted pivotally movable about a pivot axis 14, provided on a stay 13 fixed between a front side plate 1001*a* and a rear side plate 1002*b* of the printer main body 1001. The pivot axis 14 constitutes a center of pivotal movement at the skew correction of the paired skew correction rollers 2 to be explained later, and is provided, in the present embodiment, on an extension of the axes of the paired skew correction rollers 2 and in the vicinity of the rear side plate 1002*b*.

Also at the side of the front side plate of the frame 10, a gear 22 is fixed and meshes with a rack gear 23 fixed on an output shaft of a rotating motor 24 mounted on the stay 13.

When the rotating motor 24 is activated to rotate the rack gear 23 for example clockwise in FIG. 3, the frame 10 and all the members mounted thereon, including the paired skew correction rollers 2 and the drive motor 17 rotates counterclockwise about the pivoting axis 14.

Thus, by the rotation of the rotating motor 24, the paired skew correction rollers 2 can be displaced (pivoted) so as to be inclined with respect to a direction perpendicular to the sheet conveying direction. Referring to FIG. 3, a home position sensor 25, provided on the stay 13, detects a home position of a nip line of the paired skew correction rollers 2, where it becomes parallel to the rotary axis 112*b* of the photosensitive drum 112, in a rotating (pivoting) direction.

Also as shown in FIG. 3, a skew detection sensor 3, constituting skew detection means for detecting a skew in the front end of the sheet S, includes a first skew sensor 3*a* and a second skew sensor 3*b*, provided at the downstream side of the conveying direction of the paired skew correction rollers 2 and with a predetermined mutual distance L in a direction perpendicular to the sheet conveying direction. A center line 3*c*, connecting the skew sensors 3*a* and 3*b*, is made parallel to the axis 112*c* of the photosensitive drum 112 provided at the downstream side in the conveying direction.

Figure 4:
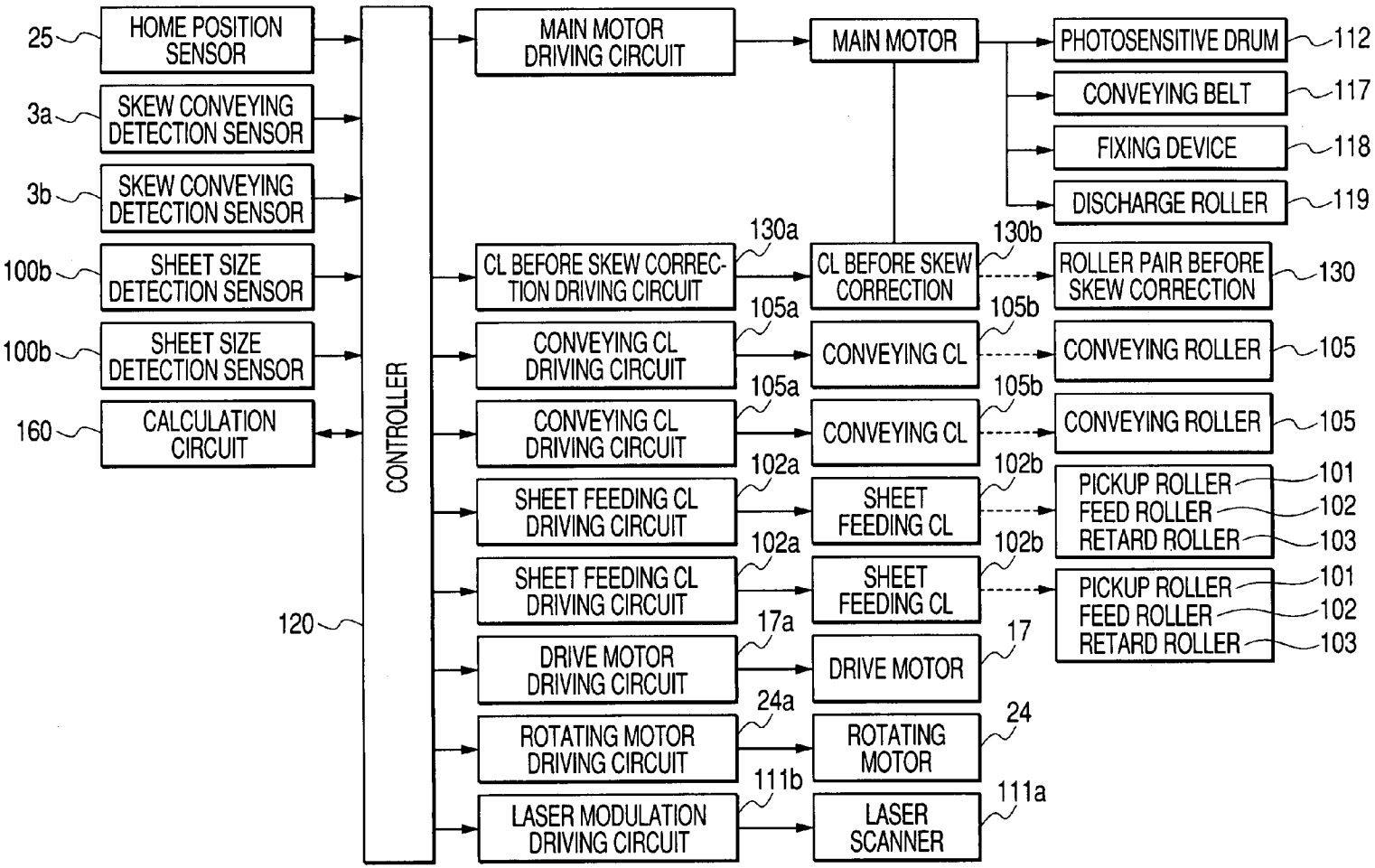
FIG. 4 is a control block diagram of the printer.

FIG. 4 is a control block diagram of the printer 1000 equipped for example with the aforementioned sheet conveying apparatus 1004. As shown in FIG. 4, the photosensitive drum 112, the conveying belt 117, the fixing device 118, and the sheet discharge rollers 119 mentioned above are directly coupled with a main motor M and are rendered rotatable in synchronization therewith. Also the pickup roller 101, the feed roller 102, the retard roller 103, the conveying roller 105 and the paired rollers 130 before skew correction mentioned above are driven by the main motor M but are drive controlled by clutches 102*b*, 105*b* and 130*b* which are respectively on/off controlled by drive circuits 102*a*, 105*a* and 130*a* through signals from the controller 120.

The controller 120, constituting control means, receives a sheet size detection signal from sheet size sensors 100*b* and 100*b* provided on the sheet cassette 100, detection signals from the skew detection sensors 3*a* and 3*b*, and a signal from the home position sensor 25. In the controller 120, a calculation circuit 160 calculates for example a skew amount of the sheet S, based on the detection signals from the skew detection sensors 3*a* and 3*b*.

Also the controller 120 outputs necessary control signals, based on the results of detection, to drive circuits 17*a*, 20*a*, 24*a* and 111*a*, and the drive motor 17, the rotating motor 24 and the laser scanner 111*a* are drive by predetermined amounts or predetermined periods through the drive circuits 17*a*, 24*a* and 111*a*.

In the present embodiment, the skew of the sheet S is corrected, as will be explained later, by pivoting the paired skew correction rollers 2 serving as the skew correction means by an angle θ (degrees), and, after such skew correction, a front end position of the sheet for example after T seconds from the detection of the sheet S by the skew detection sensors 3 is calculated by the signals from the skew detection sensors 3*a* and 3*b*.

Based on the result of such calculation, the sheet conveying speed of the paired skew correction rollers 2 is regulated until the front end of the sheet reaches the transfer portion 112*b* in such a manner that the front end of the sheet S matches the front end of the image on the photosensitive drum 112 in the transfer portion 112*b*, and, after the front end of the sheet reaches the transfer portion 112*b*, the sheet S is fed into the transfer portion 112*b* at a speed same as the peripheral speed of the photosensitive drum 112.

In this manner it is possible to precisely align the sheet S with the front end of the image on the photosensitive drum even in case of skew correction by a pivotal movement of the sheet. It is also possible to avoid complication of the apparatus and to realize a compact apparatus.

In the following, there will be given a detailed explanation, with reference to FIG. 5, on such calculation and alignment of the front end position of the sheet S.

Figure 5:
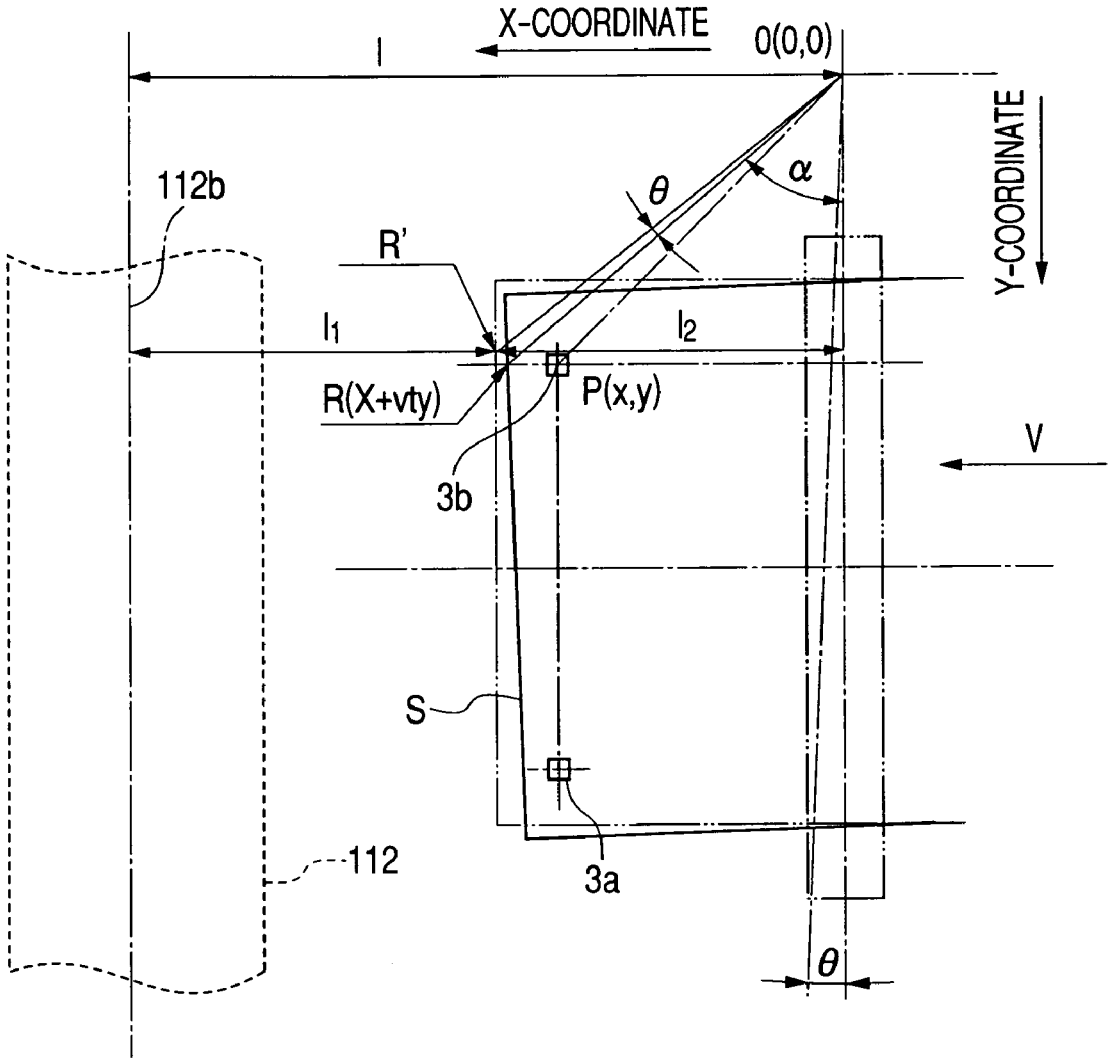
FIG. 5 is a view showing calculation and alignment of a front end position of a sheet in the sheet conveying apparatus.

Referring to FIG. 5, a point O represents the position of the pivoting axis 14 on an X-Y coordinate system, a point P represents the position of the skew detection sensor 3*b* on the X-Y coordinate system, and a point R represents the position of the front end of the sheet S at T seconds after passing the skew detection sensor 3*b* (point P). Also a point R' represents a front end position of the sheet S, subjected to skew correction by the pivotal movement about the point O, after T seconds.

By selecting the point O at the original point (0, 0), the point P at a coordinate (x, y) and a sheet conveying speed V by the paired skew correction rollers 2, the coordinate of the point R can be represented as (x+V·T, y). Thus, OR and OR' can be represented as:

$$OR=OR'=\sqrt{\{(x+V\cdot T)^2+y^2\}}.$$

Then an angle α (degrees) formed by OR and the axis 112*c* of the photosensitive drum 112 can be represented as:

$$\alpha=\tan^{-1}\{(x+V\cdot T)/y\}$$

Therefore, the X-coordinate of OR', namely the distance $I_2$ of the sheet S from the point O in a direction perpendicular to the axis 112*c* of the drum 112, can be represented as:

$$I_2=\sqrt{\{(x+V\cdot T)^2+y^2\}}\times\sin(\alpha+\theta).$$

Also, taking the distance between the point O and the transfer portion 112 as I, a distance $I_1$ of the front end of the sheet S from the transfer portion 112*b* at T seconds after detection by the skew sensor 3*b* is given by:

$$I_1=I-I_2$$

In the present embodiment, the time T (seconds) is so selected that $I_1$ becomes equal to a distance $I_0$ from the exposure position 112*a* on the photosensitive drum 112 to the transfer portion 112*b*. Also after the lapse of T seconds, a front end signal of the sheet S is given from the controller 120 to the laser scanner 111 to initiate the image writing.

Therefore, in case of absence of the skew (θ=0), and in case the conveying speed V is same as the peripheral speed of the photosensitive drum 112, the sheet S is conveyed with the conveying speed V and the image writing is initiated after the lapse of time T, whereby the front end of the sheet S matches the front end of the image in the transfer portion 112*b*, so that the front ends of the sheet S and the image can be aligned (synchronized) easily.

Also in case a skew is detected, since a deviation of the front end of the sheet S, caused by the skew correction, becomes $I_2-(x+V\cdot T)$, it is possible to align (synchronize) the front ends of the sheet S and the image easily by increasing the conveying speed of the paired skew correction rollers 2 corresponding to such deviation until the front end of the sheet reaches the transfer portion 112*b* and restoring the original conveying speed after the reaching.

However, since the paired skew correction rollers are pivoted by θ, it is necessary to calculate the conveying speed of the sheet S as a speed V' in a direction perpendicular to the rotary axis 112*c* of the photosensitive drum 112, as will be explained later with reference to FIG. 9C. Therefore, in order to maintain V' same as the peripheral speed of the photosensitive drum 112, the sheet conveying speed V of the paired skew correction rollers 2 is regulated as follows:

$$V'=V\times\cos\theta$$

Through the execution of the aforementioned correcting operations, the sheet S is advanced in a position without skew to the transfer portion 112*b*, and can realize an image formation (printing) under exact alignment.

As explained in the foregoing, it is possible to precisely align the front end of the image on the drum 112 and the front end of the sheet S in the transfer portion 112*a*, by detecting the skew of the sheet S, pivoting the paired skew correction rollers 2 according to such skew amount thereby correcting the skew, calculating the front end position of the sheet after the skew correction based on the result of detection of the sheet skewing, and controlling the sheet conveying speed based on the result of such calculation.

Figure 6:
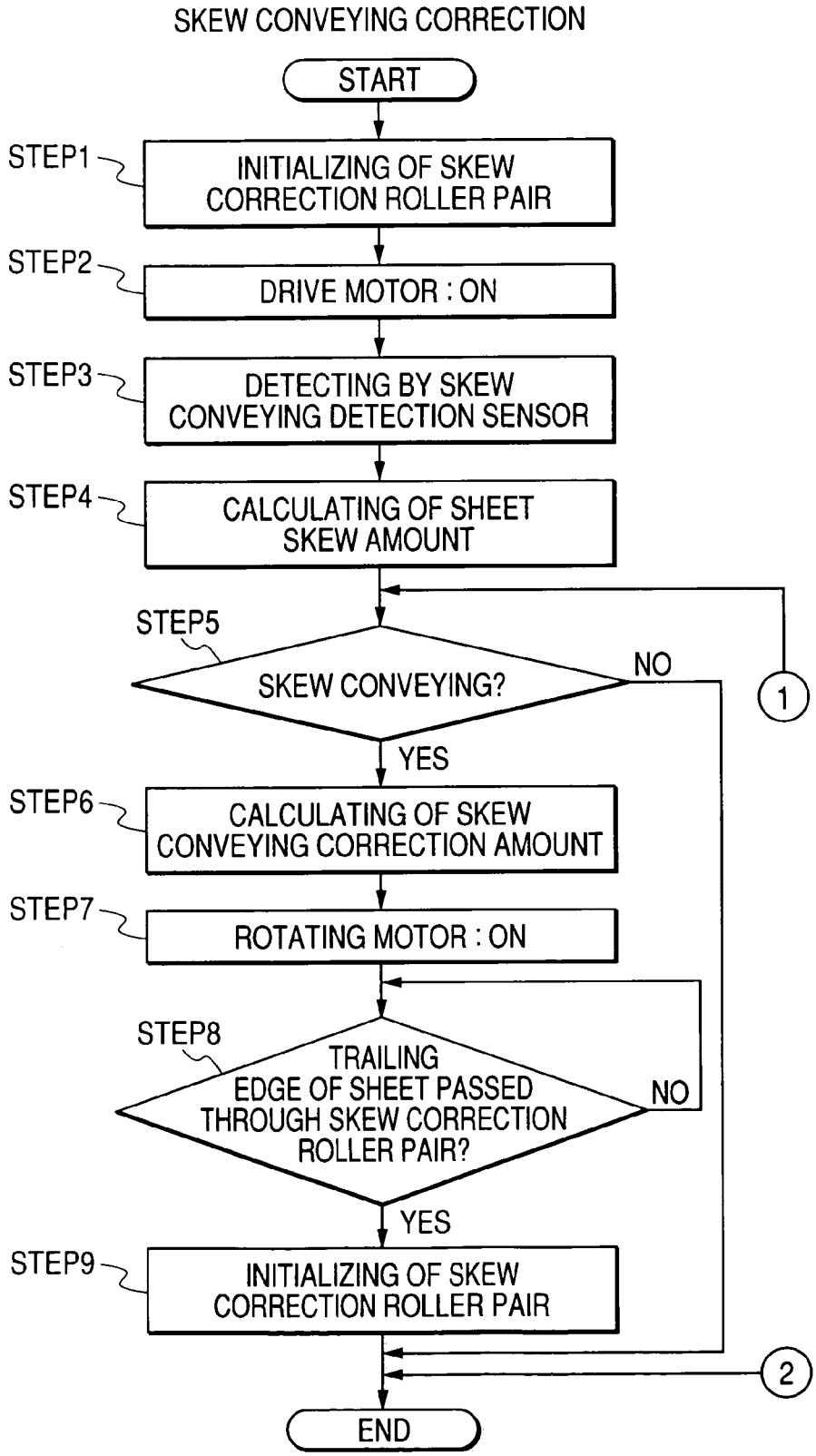
FIG. 6 is a part of a flow chart of skew correcting and aligning operations of the sheet conveying apparatus.
Figure 7:
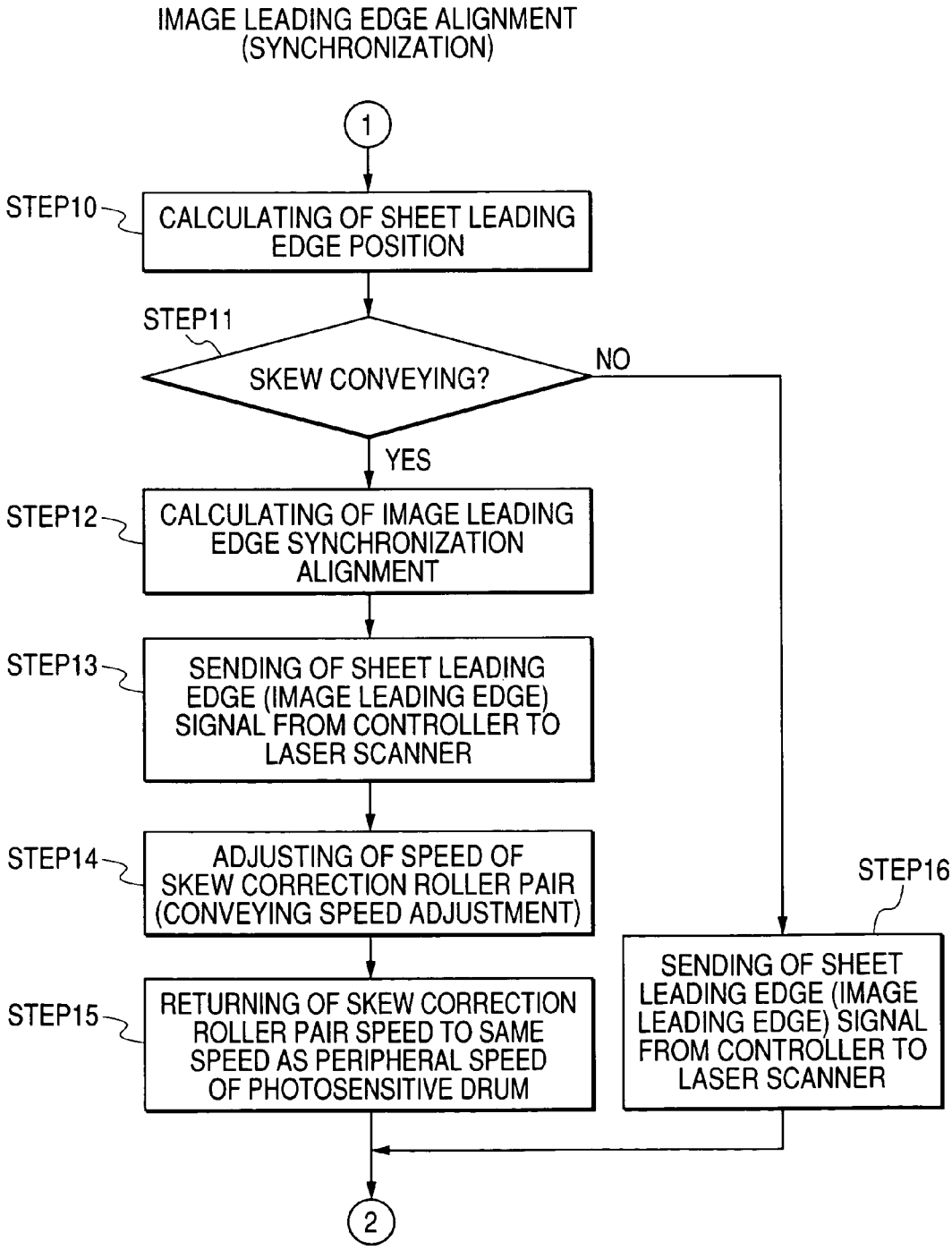
FIG. 7 is another part of a flow chart of skew correcting and aligning operations of the sheet conveying apparatus.

In the following, operations of skew correction and alignment in the printer 1000 (sheet conveying apparatus 1004) of the aforementioned configuration will be explained with reference to flow charts in FIGS. 6 and 7 and also to FIGS. 8A to 8C and 9A to 9C.

At first, when an unillustrated start button of the printer 1000 is depressed, the rotating motor 24 is activated, and an initialization of the position of the paired skew correction rollers 2 in the rotating (pivoting) direction is executed by the home position sensor 25 (step 1).

Figure 8A:
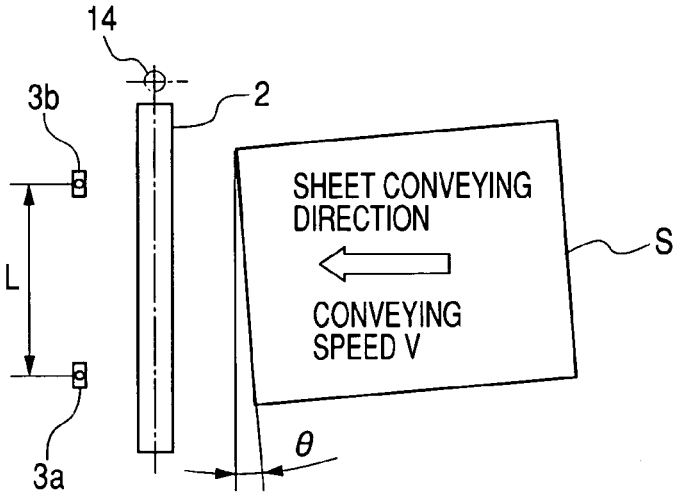
FIGS. 8A, 8B and 8C are first views showing skew correcting and aligning operations of the sheet conveying apparatus.

After this initialization, the registration motor 17 is turned on to initiate the rotation of the paired skew correction roller 2 (step 2). When a sheet S skewed by an angle θ is introduced into thus rotating paired skew correction rollers 2 as shown in FIG. 8A, the sheet then enters and is nipped in the nip portion of the paired skew correction rollers 2.

Figure 8B:
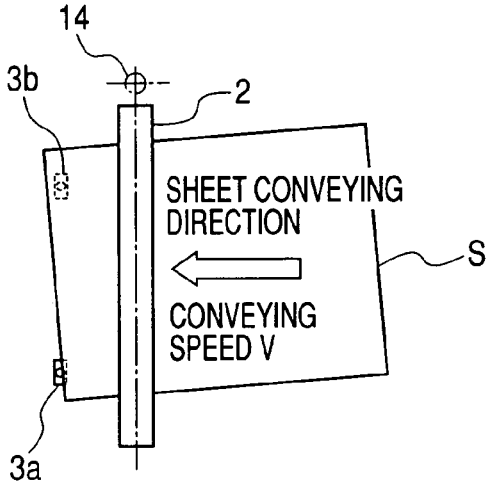

Thereafter, the sheet S nipped by the paired skew correction roller 2 advances in the skewed state along the sheet conveying direction P and is detected by the skew detection sensors 3*a* and 3*b* positioned at the downstream side of the paired skew correction rollers as shown in FIG. 8B (step 3).

Detection signals from the skew detection sensors 3*a* and 3*b* are supplied to the controller 120 and used for calculating, in the calculation circuit 160, for calculating a passing time of the front end of the sheet and a skew amount of the sheet S nipped by the paired skew correction rollers 2 (step 4).

Based on the result of calculation, the controller 120 judges presence/absence of the skew of the sheet S (step 5), and, in the absence of skew of the sheet S (case N in step 5), does not execute a correcting operation, but, in the presence of skew of the sheet S (case Y in step 5), calculates a corresponding skew correction amount, namely a drive amount of the rotating motor 24 (step 6).

Figure 8C:
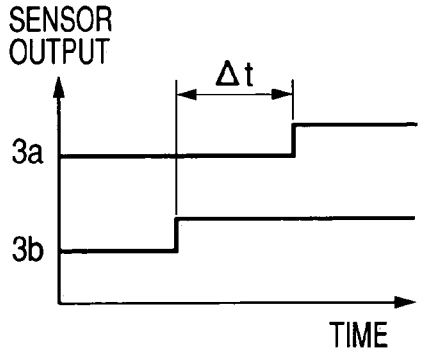
Figure 9A:
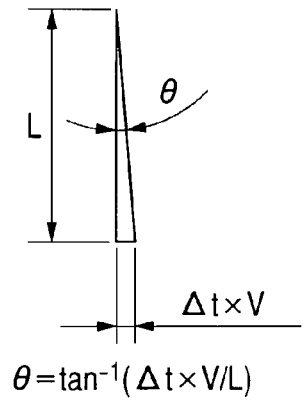
FIGS. 9A, 9B and 9C are second views showing skew correcting and aligning operations of the sheet conveying apparatus.

In case the detection timings of the skew detection sensors 3*a*, 3*b* has a difference Δt as shown in FIG. 8C, the skew amount θ of the sheet S can be calculated, from the conveying speed V of the sheet S and the pitch (distance) L of the skew detection sensors 3*a* and 3*b*, by a following equation as indicated in FIG. 9A:

$$\theta=\tan^{-1}(\Delta t\times V/L).$$

Thereafter, after the detection by the skew detection sensors, more specifically at T seconds after the detection by the skew detection sensor 3*a* in the present embodiment, the rotating motor 24 is turned on (step 7) according to the skew amount θ calculated by the foregoing equation, thereby pivoting the paired skew correction rollers 2 by the angle θ.

Figure 9B:
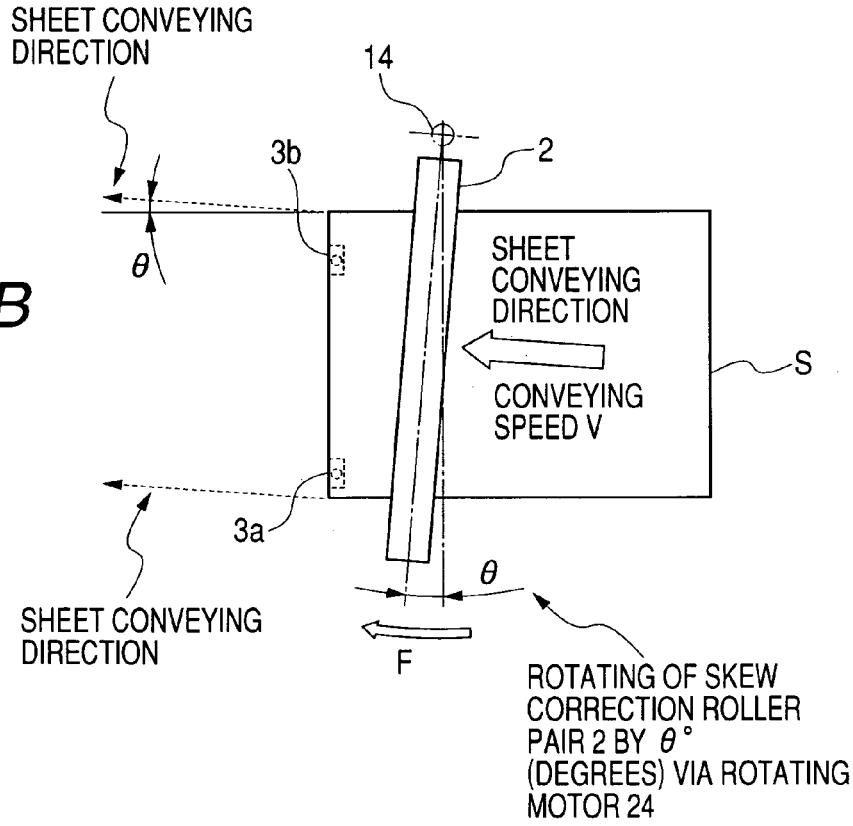
Figure 9C:
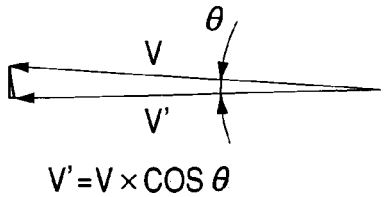

By such pivoting of the the paired skew correction rollers 2 by the angle θ, the front end of the sheet S nipped by the paired skew correction rollers 2 becomes parallel to the axial direction of the transfer portion 112*b* (axial direction of the photosensitive drum) as shown in FIG. 9B, whereby the skew of the sheet S is corrected.

Based on such correcting operation, the sheet S is advanced in an exact posture without skew with respect to the transfer portion 112*b*, and is subjected thereafter to a toner image transfer. When a rear end (trailing edge) of the sheet thereafter comes out of the paired skew correction rollers 2 (case Y in step 8), the paired skew correction rollers 2 is initialized (step 9) to prepare for a skew and a skew correction of a next sheet S. This initialization is executed according to a signal from the home position sensor 25 as explained before.

On the other hand, in the step 4, simultaneous with the calculation of the sheet skew amount, the calculation circuit 160 constituting calculation means calculates a front end position of the sheet S (front end position after T seconds from the detection by the skew detection sensor 3*a*), after the skew correction by the pivoting of the paired skew correction rollers 2 by the angle θ, utilizing the same signals from the skew detection sensors 3*a* and 3*b* as used for the skew amount θ (step 10).

In case the sheet S is skewed (case Y in step 11), there is executed a calculation for alignment of the image front end at the transfer portion 112*b* (step 12), to determine the conveying speed of the paired skew correction rollers 2 according to the deviation $\{I_2-(x+V\cdot T)\}$ of the front end of the sheet S after T seconds.

Then, at T seconds after the detection of the sheet by the skew detection sensor 3*a*, a sheet front end signal is transmitted from the controller to the laser scanner 111 (step 13), and the sheet conveying speed of the paired skew correction rollers 2 is regulated until the front end of the sheet reaches the transfer portion 112*b* in such a manner that the sheet S matches the front end of the image on the drum 112 at the transfer portion 112*b* (step 14). After the front end of the sheet reaches the transfer portion 112*b*, the sheet conveying speed of the paired skew correction rollers 2 is returned to a speed same as the peripheral speed of the photosensitive drum 112 (step 15), and there is executed an operation of feeding the sheet S into the transfer portion 112*b*.

On the other hand, in case the sheet S is not skewed (case N in step 11), at T seconds after the detection of the sheet, a sheet front end signal is transmitted from the controller 120 to the laser scanner 111 (step 16), and the sheet conveying speed of the paired skew correction rollers 2 is regulated same as the peripheral speed of the photosensitive drum 112.

Thus, the front end of the image on the photosensitive drum can be precisely aligned with the front end of the sheet S in the transfer portion 112*b*, by detecting the skew of the sheet S, pivoting the paired skew correction rollers 2 according to such skew amount thereby correcting the skew, calculating the front end position of the sheet after the skew correction based on the result of detection of the sheet skewing, and regulating the sheet conveying speed based on the calculated front end position of the sheet. It is thereby rendered possible to achieve a skew correction and an alignment of the image and the sheet of a very high precision, without once stopping the sheet.

In the foregoing, there has been explained a configuration in which the alignment of the sheet S and the front end of the image is achieved by regulating the conveying speed of the paired skew correction rollers 2, but the present invention is not limited to such configuration and the alignment can also be attained by varying the output timing of a sheet front end signal from the controller 120, thereby varying the start timing of the image writing in the laser scanner 111.

In the following, there will be explained a second embodiment of the present invention, in which the alignment is executed by varying the start timing of the image writing.

Figure 10:
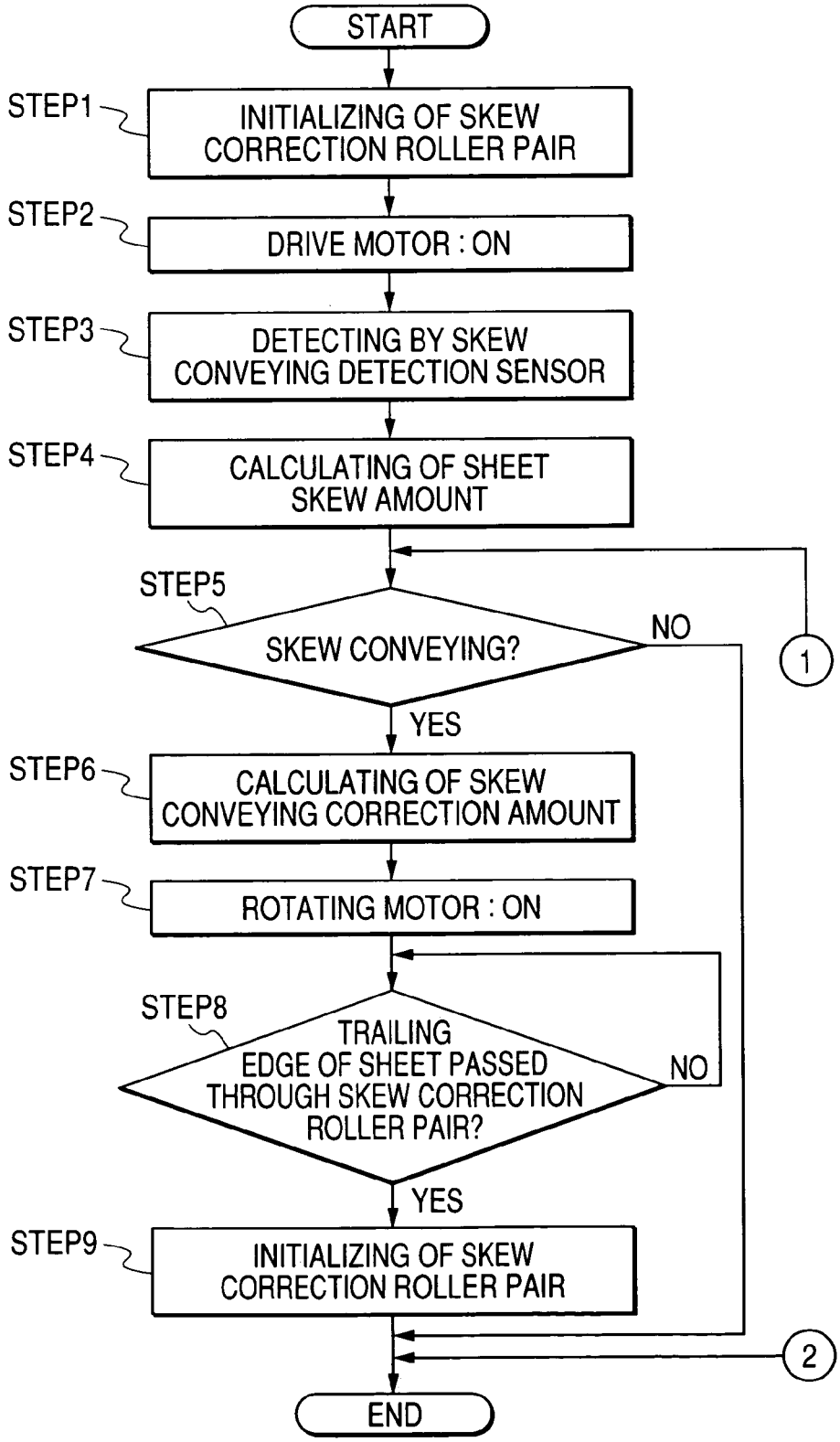
FIG. 10 is a part of a flow chart of skew correcting and aligning operations of a sheet conveying apparatus of a second embodiment of the present invention.
Figure 11:
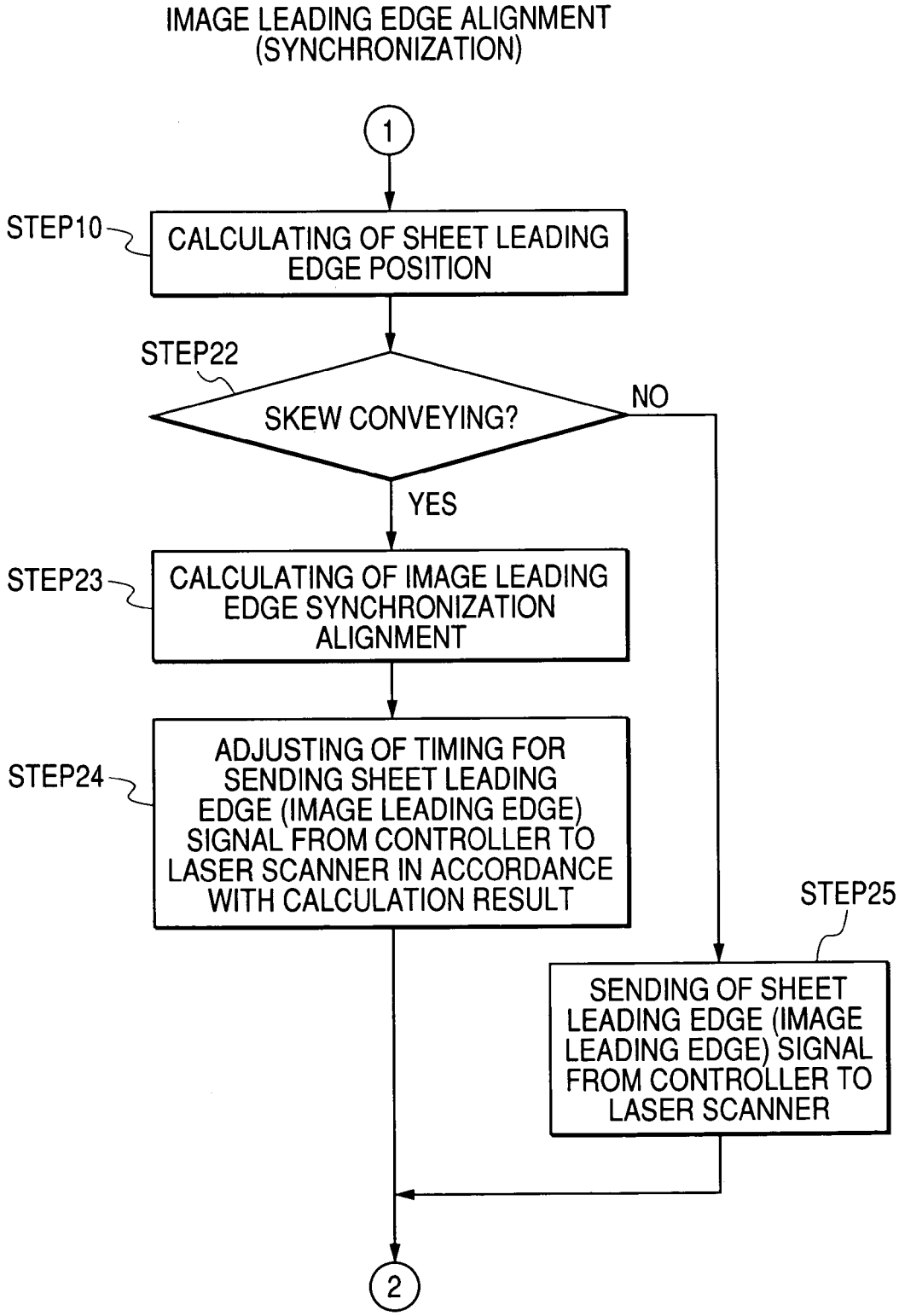
FIG. 11 is another part of a flow chart of skew correcting and aligning operations of a sheet conveying apparatus of a second embodiment of the present invention.

FIGS. 10 and 11 are flow charts showing skew correcting and aligning operations of the printer 1000 (sheet conveying apparatus 1004) of the present embodiment.

In the present embodiment, as in the first embodiment explained above, a skew amount of the sheet is calculated (step 4), and, in case the sheet is skewed (case Y in step 5), the rotating motor 24 is turned on for a predetermined time (step 7) to pivot the paired skew correction rollers 2 in a direction F about the rotary axis 14 until the front end of the sheet S nipped in the paired skew correction rollers 2 becomes parallel to the axial direction of the transfer portion 112*b* (axial direction of the photosensitive drum) as shown in FIG. 9B. The skewed conveying of the sheet S is thus corrected.

Also simultaneous with the calculation of the sheet skew amount (step 4), there is calculated a front end position of the sheet S (front end position after T seconds from the detection by the skew detection sensor 3*b*), after the skew correction by the pivoting of the paired skew correction rollers 2 by the angle θ, utilizing the same signals from the skew detection sensors 3*a* and 3*b* as used for the skew amount θ (step 21).

In case the sheet S is skewed (case Y in step 22), there is executed a calculation for aligning the image front end at the transfer portion 112*b* (step 23), and a timing of transmission of the sheet front end signal from the controller to the laser scanner 111 is regulated according to the result of calculation (step 24), thereby regulating the start timing of the image writing by the laser scanner 111.

More specifically, the start timing of image writing is delayed in case the sheet S is skewed.

Thus, the front end of the image on the photosensitive drum can be precisely aligned with the front end of the sheet S in the transfer portion 112*a*, and it is rendered possible to achieve a skew correction and an alignment of the image and the sheet of a very high precision, without once stopping the sheet.

The front end position of the sheet S at T seconds after passing the skew detection sensor 3*b* can be calculated, based on the result of detection by the skew detection sensors 3*a*, 3*b*, prior to the lapse of T seconds, so that it is possible to provide the sheet front end signal.

In case the sheet S is not skewed (case N in step 22), a sheet front end signal is transmitted from the controller 120 to the laser scanner 111 at T seconds after the detection of the sheet by the skew detection sensor 3*a* (step 25).

In such configuration, the conveying speed need only be corrected corresponding to the angle θ of the paired skew correction rollers 2 rotated for skew correction, and need not be changed until the sheet S passes through the paired skew correction rollers 2.

In the first and second embodiments explained in the foregoing, the rotary axis 14 of the paired skew correction rollers 2 is positioned on the extension of the axis of the paired skew correction rollers 2, but the present invention is not limited to such configuration, and a similar effect can be obtained also by positioning the rotary axis at a central portion of the paired skew correction rollers 2, or at the center of the transversal direction of the passing sheet S, or in other positions.

Figure 12:
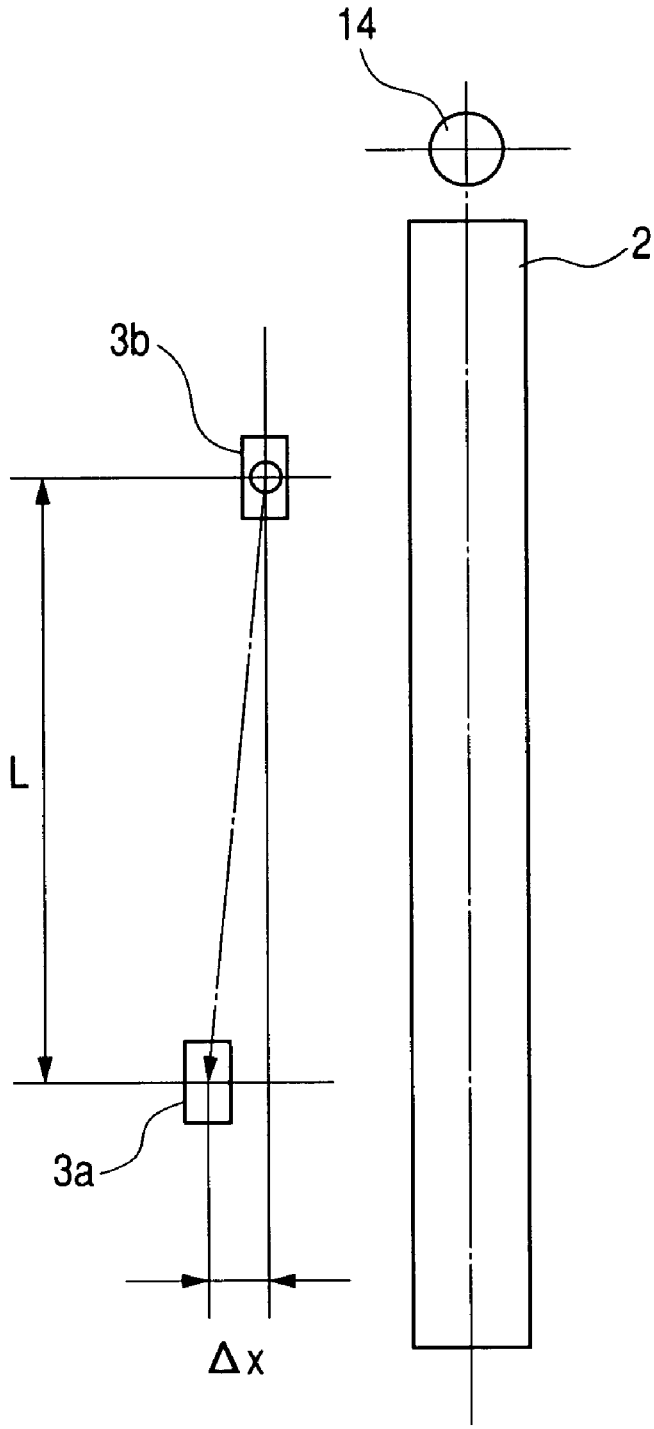
FIG. 12 is a view showing another configuration of the sheet conveying apparatus of the first and second embodiments.

Also the skew detection sensors 3*a* and 3*b* are positioned parallel to the rotary center 112*c* of the photosensitive drum 112, but a similar effect can also be obtained even in case of positioning the skew detection sensors 3*a* and 3*b* not parallel but displaced along the conveying direction as shown in FIG. 12, by a correction for such displacement Ax.

Also even in case the paired skew correction rollers 2 are not parallel to the rotary axis 112*c* of the photosensitive drum 112 prior to the nipping of the sheet S, the skew correction and the front end position alignment are possible by a similar calculation, taking into consideration that the initial conveying direction is skewed by such non-parallel angle.

Also in the foregoing, there has been explained a situation where the skew detection sensors 3*a*, 3*b* are positioned at the downstream side of the paired skew correction rollers 2, but the present invention is not limited to such configuration and the skew detection sensors 3*a* and 3*b* may be positioned at the upstream side of the paired skew correction rollers 2. Such arrangement allows to shorten the distance between the paired skew correction rollers and the transfer portion 112*b* thereby allowing to provide a more compact apparatus.

Also in the foregoing, there has been explained a case of applying the sheet conveying means of the invention to an image forming apparatus in order to eliminate a skew in the sheet S and to achieve an exact alignment with respect to the image forming portion 1003, but the present invention is not limited to such case and is applicable also for example to an image reading apparatus such as a scanner 2000 shown in FIG. 1, in order to eliminate a skew in the sheet S and to achieve an exact alignment with respect to the image reading portion.

Furthermore, in the image reading apparatus, it is possible to improve the alignment of the sheet with the reading position, even in case of correction of skew, by controlling the timing of image reading of the sheet in the image reading portion, according to the calculated front end position of the sheet.

What is claimed is:

1. A sheet conveying apparatus for conveying a sheet by sheet conveying means, comprising:

detection means which detects a skew of a conveyed sheet with respect to a sheet conveying direction;

skew correcting means which pivots, in a state nipping the sheet in a skewed state, in a direction for correcting the skew of said sheet, based on a detection signal from said detection means; and control means provided with calculation means which calculates a front end position of the sheet of which skew is corrected by a pivotal movement of said skew correcting means, based on a detection signal from said detection means, wherein said skew correcting means conveys the sheet corrected for said skew at a predetermined timing and said control means controls the sheet conveying speed of said skew correction means according to the front end position, calculated by said calculation means, of the sheet corrected for said skew.

2. An image forming apparatus provided with an image forming portion including an image bearing member on which an image is formed, and a transfer portion for transferring the image formed on said image bearing member onto a sheet, comprising:

detection means which detects a skew of a conveyed sheet with respect to a sheet conveying direction;

skew correction means which pivots, in a state nipping the sheet in a skewed state, in a direction for correcting the skew of said sheet, based on a detection signal from said detection means; and control means provided with calculation means which calculates a front end position of the sheet of which said skew is corrected by a pivotal movement of said skew correcting means, based on a detection signal from said detection means;

wherein said control means controls the sheet conveying speed of said skew correction means according to the calculated front end position of the sheet, thereby aligning the sheet conveyed by said skew correction means with an image in said transfer portion.

3. An image forming apparatus provided with an image forming portion including an image bearing member on which an image is formed, and a transfer portion for transferring the image formed on said image bearing member onto a sheet, comprising:

a pair of skew detection sensors provided in a direction perpendicular to a sheet conveying direction;

skew correction rollers provided pivotably;

a drive motor for pivoting said skew correction rollers;

a calculation circuit for calculating a skew amount of the sheet utilizing a signal from said skew detection sensors; and control means for so controlling said drive motor as to pivot said skew correction rollers in a state pinching the sheet in a skewed state based on the skew amount calculated by said calculation circuit and calculating a front end position of the sheet corrected for the skew by the pivoting of said skew correction means based on a detection signal from said detection means;

wherein said control means controls the sheet conveying speed of said skew correction rollers according to the calculated front end position of the sheet, thereby aligning the sheet conveyed by said skew correction rollers with an image in said transfer portion.

* * * * *

UNITED STATES PATENT AND TRADEMARK OFFICE

CERTIFICATE OF CORRECTION

PATENT NO. : 7,303,191 B2
APPLICATION NO. : 10/899077
DATED : December 4, 2007
INVENTOR(S) : Takagi et al.

It is certified that error appears in the above-identified patent and that said Letters Patent is hereby corrected as shown below:

COLUMN 11:
Line 25, "displacement Ax." should read --displacement $\Delta X$.--.

Signed and Sealed this

Eighth Day of July, 2008

JON W. DUDAS
*Director of the United States Patent and Trademark Office*